United States Patent [19]

Vanicek

[11] 3,972,128

[45] Aug. 3, 1976

[54] PROCESS FOR DRYING HYGROSCOPIC MATERIALS

[76] Inventor: Viktor Vanicek, Hamerlingplatz 7, 1080 Vienna, Austria

[22] Filed: Dec. 20, 1973

[21] Appl. No.: 426,905

[30] Foreign Application Priority Data

Jan. 8, 1973 Austria ..... 146/73

[52] U.S. Cl. ..... 34/32; 34/50; 34/54

[51] Int. Cl.[2] ..... F26B 3/00

[58] Field of Search ..... 34/26, 27, 28, 29, 30, 34/31, 32, 50, 54

[56] References Cited

UNITED STATES PATENTS

| | | | |
|---|---|---|---|
| 1,490,569 | 4/1924 | Krick | 34/26 |
| 3,209,465 | 10/1965 | Arena | 34/50 |
| 3,468,036 | 9/1969 | Blaetter | 34/26 |
| 3,744,144 | 7/1973 | Weis | 34/16.5 |

FOREIGN PATENTS OR APPLICATIONS

| | | |
|---|---|---|
| 268,999 | 2/1969 | Austria |

*Primary Examiner*—Carroll B. Dority, Jr.
*Assistant Examiner*—Larry I. Schwartz
*Attorney, Agent, or Firm*—John J. Dennemeyer

[57] ABSTRACT

A process for drying hygroscopic materials in which the atmospheric condition for removing the humidity from the hygroscopic materials by a suitable drying means is automatically adjusted to maintain a predetermined temperature difference between the dry and wet temperatures in response to a variation of one of these temperatures. When the drying means is not sufficiently humid to effectively remove the humidity from the drying material, any action tending to reduce the humidity from the drying means is interrupted until it again reaches a predetermined value.

12 Claims, 1 Drawing Figure

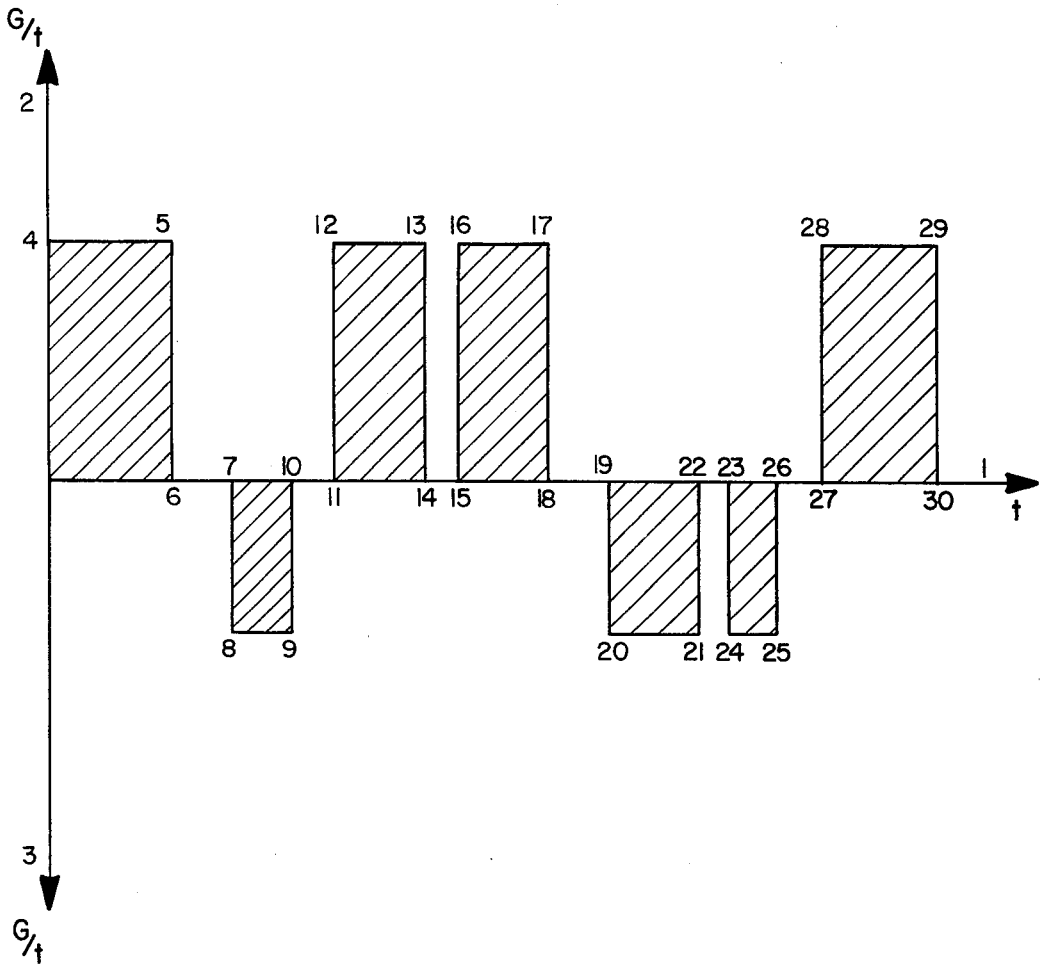
G/t
2
4
5
12
13
16
17
28
29
7
10
19
22
23
26
1
6
11
14
15
18
27
30
t
8
9
20
21
24
25
3
G/t

PROCESS FOR DRYING HYGROSCOPIC MATERIALS

The invention relates to a process for drying materials, particularly hygroscopic materials, and comprises means for automatically controlling the atmospheric conditions in the drying installation, wherein the main temperatures of the drying atmosphere, particularly the dry temperature and wet temperature, are coupled for control purposes in such a manner that whenever a variation occurs in one of the two temperatures the other temperature is consequently corrected so that the difference between the two temperatures remains constant.

The invention relates particularly to a process of the above-mentioned type wherein the incoming or fresh-air exchange is cut back in the drying installation whenever the temperature difference drops below a predetermined fixed value, and it is an object of the invention to effect the drying of the hygroscopic materials in such a manner that optimum conditions are obtained by means of an automatic adjustment in the border layer of the drying means as well as in the border layer of the drying material.

In a drying process, particularly in the drying of hygroscopic materials, for example wood, the humidity of the material is first transferred to the drying means and removed via the drying means with the aid of special devices from the drying installation. This can be effected in that, for example in the case of air as drying means, the dehumidifying of the drying means is carried out in stages through a fresh-air exchange, so that the fresh air which has a relatively low water content is introduced into the drying installation and outgoing air with a relatively high water content is removed from the installation, and the existing air humidity in the drying chamber is adjusted to a predetermined value according to the conditions of the drying process.

Other methods for removing the water from the drying material are known, for example by cooling one portion of the drying means below the melting point so that water is released in liquid form and discharged.

An optimum drying process is obtained in the case where the water is transferred from the drying material to the drying means in a continuous manner and undesirable features do not develop in the drying material such as an undesirable deformation or cracks.

In order to provide a control of the atmosphere in the drying installation of the prior art process mentioned above (Austrian Pat. No. 268,999) the dry and wet temperatures vary equally in direction, time and value. When for example the value of the air humidity drops below the desired value, i.e. when the amount of water released from the drying material decreases, whereby the air becomes drier, it is possible to disconnect temporarily the removal installation for the drying means in order to maintain the temperature difference constant, until the desired value is reached again by a release of the water from the drying material to the drying means. This is always the case provided that the surface of the drying material does not dry out or harden and ultimately form a crust, and that the water transfer from the inside of the drying material to the outside is not interrupted. As soon as a hard crust forms on the drying material, or an interruption of the water transfer from the inside to the surface of the drying material occurs, the drying process can be continued only after wetting the crust of the drying material. The alternating effect in the energy exchange between the drying means and the drying material, namely the release of heat energy to the surface of the drying material which is used partly to heat the drying material but which serves during the drying process almost exclusively for the evaporation of the water, takes place in the border layer of the drying means and in the border layer of the drying material.

In the drying material a humidity distribution and a temperature distribution also take place, which is comparable with the atmospheric condition of the drying means. In the drying material, however, additional tensions arise which are of considerable importance for the proper operation of the drying process. If one compares during this drying process the mass which is present in the border layer of the drying material it will be seen that the proportion of the mass in the border layer of the drying material is hundreds of times greater than that of the drying means.

During the control of the atmosphere one recognizes this condition from the fact that the change of the drying temperature can take place relatively fast while the wet temperature, which has an alternating effect relative to the condition of the surface of the drying material, can be adjusted only slowly. This realization is the basis of the present invention.

According to this invention the action of removing the humidity is interrupted for a predetermined period of time when the drying means is not sufficiently humid. This can be obtained for example by stopping the incoming—outgoing air exchange and/or by stopping the action of reducing the humidity of the drying means by means of condensation.

According to a special embodiment one can also proceed in such a manner that after termination of the interruption period, in case the required humidity of the drying means has not been obtained by a release of water from the drying material, a wetting of the drying means is effected, until its humidity has reached the predetermined value or exceeds it.

The exchange of incoming—outgoing air may be started up again only after the expiration of a predetermined time interval, or the reduction of the humidity can be effected again by means of condensation, when the humidity of the drying means maintains the predetermined value during the time interval.

If within the mentioned period the humidity of the drying means should again increase or decrease the mentioned procedures will be periodically repeated.

An embodiment of the procedure according to the invention will be described hereafter with reference to the accompanying drawing showing a representative diagram.

In the drawing the abcissa 1 represents the procedure according to the invention in respect of the time duration, the positive ordinate 2 represents the amount of water removed during the drying process per time unit $G/t$, and the negative ordinate 3 represents the amount of water supplied during the drying process per time unit $G/t$.

At the starting point 4 of the process water is removed from the treating cycle by outgoing air. At 5 the actual value of the air humidity begins to drop below the desired value, and the outgoing air is interrupted at 6. From this moment onward the time clock which is switched ahead of the spraying device operates up to 7. The spraying action sets in at 8 until the desired value of the air humidity is reached again at 9. After switching off the spraying action at 10 a time switch which is connected ahead of the outgoing air device is activated. After a predetermined time interval the incoming—outgoing air device is operated again at 12 and is disconnected again only at 13, as soon as the dropping air humidity goes below the desired value. At 14 the time clock starts to run again. As the desired value of the air humidity is reached within the prescribed time the incoming—outgoing air device is activated automatically at 16 and operates up to 17. At 18 begins a new operating period of the time clock which is switched ahead of the spraying action. As an automatic wetting of the drying means by the drying material does not occur the spraying action begins at 19 for a timed period from 20 to 21. The desired value of the air humidity is reached and exceeded, the spraying action is disconnected at 22, and the time clock switched ahead of the dehumidifying action starts to run again. As the air humidity of the drying means drops due to the release of water by the drying means to the drying material before the predetermined time interval has elapsed another spraying action sets in at 23.

At 24 spraying is effected up to 25 and disconnected, whereupon the process described above is repeated depending on the release of water by the drying material.

When within the waiting period the air humidifying action by the drying material is sufficient during the switching from outgoing air to spraying action in order to re-establish the desired value of the air humidity no spraying action sets in. On the other hand, when within the waiting period during the switch-over from spray action to incoming-air exchange the actual value of the air humidity drops below the desired value the automatic spraying action keeps setting in until the condition of the air humidity is met and does not drop during the predetermined time interval.

The above-described processes can also be carried out in such a way that the water removal or the water addition is not cut down abruptly as illustrated in the diagram but may be reduced gradually.

What is claimed is:

1. A process for drying hygroscopic materials at a predetermined humidity value which remains substantially constant throughout the process utilizing an automatic control associated with at least one timing means and humidity reduction means comprising the steps of:

activating humidity reduction means to lower the humidity of the drying means, interrupting humidity reduction means when the humidity of the drying means reaches or drops below a predetermined humidity value, and allowing a predetermined time interval for the humidity of the drying means to return to the predetermined humidity value in response to the release of moisture from drying material.

2. The process of claim 1 further comprising the steps of:

activating humidifying means to initiate humidity addition to the drying means if it has not attained said predetermined humidity value by the end of said predetermined time interval, and interrupting the humidity addition when the humidity of the drying means reaches or exceeds the predetermined humidity value.

3. The process of claim 2 further comprising the step of allowing the humidity of the drying means to return to the predetermined value in response to the normal absorption of moisture by the drying material during a second predetermined time interval.

4. The process of claim 3 wherein said predetermined time interval and said second predetermined time interval are at least approximately equal.

5. The process of claim 3 wherein reactivation of said humidifying means occurs before the termination of said second predetermined time interval.

6. The process of claim 1 wherein reactivation of said humidity reduction means occurs before the termination of said predetermined time interval.

7. The process of claim 1 wherein said humidity reduction means comprises incoming and outgoing air exchange means.

8. The process of claim 1 wherein humidity reduction is effected by condensation.

9. The process of claim 1 wherein the humidity of the drying means is sensed and controlled by the wet bulb and dry bulb temperatures thereof.

10. A process for drying hygroscopic materials at a predetermined humidity value utilizing an automatic control associated with at least one timing means, humidity reduction means and humidifying means comprising the steps of:

activating humidity reduction means to initiate humidity removal from drying means, interrupting the humidity removal when the humidity of the drying means reaches or drops below a predetermined humidity value, allowing the humidity of the drying means to return to the predetermined humidity value in response to the normal release of moisture from drying material during a predetermined time interval during which, if the humidity of the drying means reaches or exceeds said predetermined humidity value, reactivating said humidity reduction means, and if said predetermined humidity value is not reached or exceeded by the end of said predetermined time interval, activating humidifying means to initiate humidity addition to the drying means, interrupting the humidity addition when the humidity of the drying means reaches or exceeds the predetermined humidity value, allowing the humidity of the drying means to return to the predetermined humidity value in response to the absorption of moisture by the drying material during a predetermined time interval during which, if the humidity of the drying means reaches or drops below said predetermined humidity value, reactivating said humidifying means, and if the humidity of the drying means does not reach or drop below said predetermined humidity value by the end of said predetermined time interval, reactivating said humidity reduction means.

11. A process for drying hygroscopic materials which comprise contacting a hygroscopic material with a drying means, activating humidity reduction means to remove humidity from said drying means, interrupting the humidity removal when the humidity of said drying means reaches or drops below a predetermined humidity value, allowing the humidity of the drying means to increase in response to the normal release of moisture from said hygroscopic material during a first predetermined time interval, determining the humidity of the drying means at the end of said time interval whereupon the humidity of the drying means is increased when the humidity value is below said predetermined value, waiting a second predetermined period of time, reactivating said humidity reduction means, and repeating said procedure until the hygroscopic material is dried.

12. A process for drying hygroscopic materials at a predetermined humidity value which remains substantially constant throughout the process utilizing an automatic control associated with at least one timing means, humidity reduction means to lower the humidity of drying means, and means to determine the humidity of the drying means, where the humidity reduction means is activated when the humidity of the drying means rises above the predetermined humidity value and interrupted when the humidity of the drying means drops below the predetermined humidity value, wherein the improvement comprises:

allowing a predetermined time interval for the humidity of the drying means to return to the predetermined humidity value in response to the release of moisture from the drying material due to the redistribution of moisture within the drying material.

* * * * *